US010667065B2

(12) United States Patent
Thaysen

(10) Patent No.: US 10,667,065 B2
(45) **Date of Patent: *May 26, 2020**

(54) HEARING INSTRUMENT HAVING AN ANTENNA SYSTEM

(71) Applicant: GN HEARING A/S, Ballerup (DK)

(72) Inventor: Jesper Thaysen, Skovlunde (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/433,549

(22) Filed: Jun. 6, 2019

(65) Prior Publication Data

US 2019/0289411 A1 Sep. 19, 2019

Related U.S. Application Data

(63) Continuation of application No. 15/960,987, filed on Apr. 24, 2018, now Pat. No. 10,425,749.

(30) Foreign Application Priority Data

Jun. 9, 2017 (EP) ..... 17175135

(51) Int. Cl.
*H04R 25/00* (2006.01)
*H01Q 1/27* (2006.01)

(52) U.S. Cl.
CPC ..... *H04R 25/554* (2013.01); *H01Q 1/273* (2013.01); *H04R 25/552* (2013.01);
(Continued)

(58) Field of Classification Search
CPC .... H04R 25/55; H04R 25/552; H04R 25/554; H04R 25/556; H04R 25/558; H04R 25/00; H04R 2225/51
(Continued)

(56) References Cited

U.S. PATENT DOCUMENTS

2005/0111682 A1 5/2005 Essabar et al.
2011/0019830 A1 1/2011 Leibman et al.
(Continued)

FOREIGN PATENT DOCUMENTS

EP 2 871 859 A1 5/2015

OTHER PUBLICATIONS

Extended European Search Report and Search Opinion dated Jan. 22, 2018 for corresponding European Application No. 17175135.7.
(Continued)

*Primary Examiner* — Thjuan K Addy
(74) *Attorney, Agent, or Firm* — Vista IP Law Group, LLP

(57) ABSTRACT

A hearing instrument comprises a microphone for reception of sound and conversion of the sound into a first audio signal, a signal processor for processing the first audio signal into a second audio signal compensating a hearing loss of a user of the hearing aid, a speaker connected to an output of the signal processor for converting the second audio signal into an output sound signal and a wireless communication unit connected to the signal processor for wireless communication interconnected with an antenna system for emission and reception of an electromagnetic field. The antenna system comprises a plurality of antenna elements and a switching device. The switching device is configured to actively feed a first antenna element of the plurality of antenna elements, and passively feed at least a second antenna element of the plurality of antenna elements, in response to switch control information.

14 Claims, 6 Drawing Sheets

(52) U.S. Cl.
CPC ..... *H04R 25/558* (2013.01); *H04R 2225/51* (2013.01); *H04R 2225/55* (2013.01); *H04R 2225/61* (2013.01)

(58) Field of Classification Search
USPC ..... 381/315, 312, 23.1, 311, 26, 309, 60
See application file for complete search history.

(56) References Cited

U.S. PATENT DOCUMENTS

| | | | | |
|---|---|---|---|---|
| 2014/0010392 | A1* | 1/2014 | Kvist | H04R 25/554<br>381/315 |
| 2014/0185813 | A1* | 7/2014 | Ozden | H04R 25/552<br>381/23.1 |
| 2015/0131830 | A1* | 5/2015 | Pinto | H04R 25/55<br>381/315 |
| 2015/0207225 | A1 | 7/2015 | Kodama et al. | |

OTHER PUBLICATIONS

Partial European Search Report dated Oct. 13, 2017 for corresponding European Application No. 17175135.7.
Communication pursuant to Article 94(3) dated Nov. 20, 2019 for corresponding European Application No. 17175135.7.

* cited by examiner

HEARING INSTRUMENT HAVING AN ANTENNA SYSTEM

RELATED APPLICATION DATA

This application is a continuation of U.S. patent application Ser. No. 15/960,987 filed on Apr. 24, 2018, now U.S. Pat. No. 10,425,749, which claims priority to, and the benefit of, European Patent Application No. EP 17175135.7 filed on Jun. 9, 2017. The entire disclosure of the above application is expressly incorporated by reference herein.

FIELD OF TECHNOLOGY

The present disclosure relates to hearing instruments for compensating a hearing loss of a user, particularly hearing instruments having wireless communication capabilities and thus hearing instruments comprising antennas for communication.

BACKGROUND

Hearing instruments have over the later years been increasingly able to communicate with the surroundings, including communicating with remote controls, spouse microphones, other hearing instruments and lately also directly with smart phones and other external electronic devices.

Hearing instruments are very small and delicate devices and to fulfil the above requirements, the hearing instruments need to comprise many electronic and metallic components contained in a housing small enough to fit in the ear canal of a human or behind the outer ear. The many electronic and metallic components in combination with the small size of the hearing instrument housing impose high design constraints on the radio frequency antennas to be used in hearing instruments with wireless communication capabilities.

Moreover, antennas, typically radio frequency antennas, in the hearing instruments have to be designed to achieve a satisfactory battery lifetime, good communication for all sizes and shapes of heads, ears and hair, in all environments and with as large frequency bandwidth as possible despite the space limitation and other design constraints imposed by the size of the hearing aid.

SUMMARY

It is an object to overcome at least some of the disadvantages as mentioned above, and it is a further object to provide a hearing instrument capable of wireless communication.

According to a first aspect, a hearing instrument is provided, the hearing instrument comprising a microphone for reception of sound and conversion of the received sound into a corresponding first audio signal, a signal processor for processing the first audio signal into a second audio signal compensating a hearing loss of a user of the hearing instrument, a speaker connected to an output of the signal processor for converting the second audio signal into an output sound signal, a wireless communication unit connected to the signal processor for wireless communication interconnected with an antenna system for emission and reception of an electromagnetic field, the antenna system comprising a plurality of antenna elements and a switching device. The switching device is configured to connect a first antenna element of the plurality of antenna elements to the wireless communication unit, and at least a second antenna element of the plurality of antenna elements to a ground potential of the hearing instrument in response to switch control information.

According to another aspect, a method of configuring a hearing instrument is provided. The hearing instrument comprises a microphone for reception of sound and conversion of the received sound into a corresponding first audio signal, a signal processor for processing the first audio signal into a second audio signal compensating a hearing loss of a user of the hearing aid, a speaker connected to an output of the signal processor for converting the second audio signal into an output sound signal, a wireless communication unit (transceiver) connected to the signal processor for wireless communication interconnected with an antenna system for emission and reception of an electromagnetic field, the antenna system comprising a plurality of antenna elements and a switching device. The method comprises determining an intended operational position of the hearing instrument, in accordance with the determined intended operational position of the hearing instrument, providing switch control information to the switching device, switching the switching device so that a first antenna element of the plurality of antenna elements is connected to the wireless communication unit, and a second antenna element of the plurality of antenna elements is connected to a ground potential of the hearing instrument in response to the received switch control information.

In some embodiments, the switching device is configured to perform a single switching operation.

According to a further aspect, a hearing instrument is provided, the hearing instrument comprising a microphone, a speaker, an electronic circuit and a wireless communication unit for wireless communication interconnected with an antenna system for emission and reception of an electromagnetic field, the antenna system comprising a plurality of antenna elements and a switching device. The switching device is configured to connect a first antenna element of the plurality of antenna elements to the wireless communication unit, and at least a second antenna element of the plurality of antenna elements to a ground potential of the hearing instrument in response to switch control information.

The wireless communication unit is configured for wireless communication, including wireless data communication, and is in this respect interconnected with the antenna for emission and reception of an electromagnetic field. The wireless communication unit may comprise a transmitter, a receiver, a transmitter-receiver pair, such as a transceiver, a radio unit, etc. The wireless communications unit may be configured for communication using any protocol as known for a person skilled in the art, including Bluetooth, including Bluetooth Low Energy, Bluetooth Smart, etc., WLAN standards, manufacture specific protocols, such as tailored proximity antenna protocols, such as proprietary protocols, such as low-power wireless communication protocols, such as CSR mesh, etc.

The hearing instrument may be any hearing instrument, such as any hearing instrument compensating a hearing loss of a user of the hearing instrument, or such as any hearing instrument providing sound to a user.

In some embodiments, the hearing instrument comprises at least one behind-the-ear module configured to be positioned behind the ear of a user when provided in its intended operational position. Traditionally, the behind-the-ear module comprises at least the signal processor, the wireless communication unit, and in some embodiments at least one antenna element. A hearing instrument battery is typically also provided in the behind the ear element.

The hearing instrument may be a behind-the-ear type hearing instrument, in which the behind-the-ear module comprises the hearing instrument components provided as an assembly and mounted in a housing being configured to be worn behind the ear of a user in the operational position. Typically, a sound tube extends from the hearing instrument housing to the ear canal of the user.

The hearing instrument may be a receiver-in-the-ear type hearing instrument, in which the receiver is positioned in the ear, such as in the ear canal, of a user during use, for example as part of an in-the-ear module, while other hearing instrument components, such as the processor, the wireless communication unit, the battery, etc. are provided as a behind-the-ear module. Typically, a tube connects the in-the-ear module and the behind-the-ear module. It should be envisaged that the tube module comprising the tube, may comprise further hearing instrument components and connectors.

The hearing instrument may be an in-the-ear or completely-in-the-canal type hearing instrument in which the hearing instrument is provided in the ear of a user. Thus, the in-the-ear module comprises the hearing instrument components, including the processor, the wireless communication unit, the battery, the microphone and speaker, etc.

The in-the-ear module may have one or more parts extending into the ear canal. The in-the-ear module may thus be configured to be positioned in the ear and in the ear canal.

Any combination of the modules as well as any distribution of hearing instrument components between the modules as set out above may be envisaged. For example a hearing instrument having most of the hearing instrument components provided in an in-the-ear module may for example have a power source, such as a battery, provided in a behind the-ear-module and having only a power connection through the tube module. In some examples, such a behind-the-ear module may also comprise one or more antenna elements.

For example, in some embodiments, a behind-the-ear hearing instrument may be provided having a behind the ear module, an in-the-ear module and a connection between the two modules, such as a tube module. Typically, the hearing instrument components may be distributed between the modules. In many hearing instruments, the receiver is positioned in the in-the-ear module.

In some embodiments, the hearing instruments have an in-the-ear module, and no behind-the-ear module. For example, the hearing instrument may consist of an in-the-ear module, in which all the hearing instrument components are provided in the in-the-ear module In some embodiments, the hearing instruments have an in-the-ear module, and an additional module interconnected to the in-the-ear module, the additional module may be configured to be provided in the outer ear, such as in the concha of the ear, in the helix of an ear, the additional module may be configured to be positioned anywhere at the ear at a position which is not behind the ear of the user. The additional module may comprise a microphone and/or other transducer components, a battery, etc.

Such and further types of hearing instruments are typically promoted under names such as ITE, in-the-ear, full shell, ITE, in-the-ear, half shell, ITC, in-the-canal, IIC invisible-in-the-canal, CIC completely-in-the-canal, MIH, microphone-in-the-helix, etc.

It will be appreciated that the speaker of a hearing instrument is also known in the art as a "receiver". The term speaker is used herein to avoid confusion with other hearing instrument components.

The antenna system comprises a plurality of antenna elements and a switching device. In one or more embodiments, the plurality of antenna elements is a plurality of electrically conducting members. An antenna element connected to a wireless communication unit or a ground potential is an antenna element configured to emit and receive electromagnetic radiation. The plurality of antenna elements may be separate elements. At least some of the antenna elements may have a free end.

At least a first antenna element of the plurality of antenna elements is connected to the wireless communication unit, thus the first antenna element may be an actively fed antenna. At least a second antenna element of the plurality of antenna elements is connected to a ground potential of the hearing instrument, thus the second antenna element may be a passively fed antenna element.

In some embodiments, the first antenna element is provided on a first side of the hearing instrument, and the second antenna element is provided on a second side of the hearing instrument. The first antenna element and the second antenna element may be provided at opposite sides of the hearing instrument. For example, the first antenna element and the second antenna element may be provided on opposite sides of the behind-the-ear module. The first antenna element and the second antenna element may be provided on opposite sides of the in-the-ear module.

In some embodiments, the first antenna element is provided at least partly with a first of the above mentioned modules, and the second antenna element is provided at least partly with a second module, respectively.

In some embodiments, the first side of the hearing instrument is adjacent a user's head when the hearing instrument is worn in an operational position at the ear of a user. An opposite side is the side of the hearing instrument pointing away from the head of a user when the hearing instrument is worn in an operational position at the ear of a user. For example, for a behind-the-ear hearing instrument, the opposite side may be pointing towards the ear lobe of a user, when positioned in the intended operational position.

For an antenna element provided along a first side of the hearing aid being adjacent a user's head, the influence on a radiation pattern of radiation emitted from that antenna element caused by the head of the user will be more pronounced than for an antenna element provided along another side of the hearing instrument. The influence of the head will be at a maximum for the antenna element provided along a first side of the hearing aid being adjacent a user's head. For an antenna element provided along a side pointing away from the user's head, or along a side along which the hearing instrument is shielding the antenna element from the influence of the head of a the user, the influence on a radiation pattern of radiation emitted from that antenna element caused by the head of the user will be minimized, and may be at a minimum.

It has been found that the difference in emitted electromagnetic radiation by an antenna system in which the active antenna element is positioned adjacent the head of a user and an antenna system in which the active antenna element is positioned away from the head of a user does influence the overall performance of the antenna system.

It is an advantage of being able to switch the active antenna element so that it is ensured that the passive antenna element is adjacent the user's head, while the active antenna element is on an opposite side of the hearing instrument, such as furthest away from the user's head when the hearing instrument is worn in it intended operational position at the user's head.

The first antenna element and the second antenna element may be symmetric antenna elements, so that the form and shape of the first antenna element corresponds to the form and shape of the second antenna element. The first antenna element and the second antenna element may be formed and shaped so that the overall electromagnetic radiation from the hearing instrument, such as the overall electromagnetic radiation from the hearing instrument in free space, is substantially the same irrespectively of whether the first antenna element or the second antenna element is connected to the radio.

In some embodiments, the first antenna element and the second antenna element may have substantially a same shape and form, including a same or similar length, a same or similar geometry, etc. In some other embodiments, the first antenna element and the second antenna element may have substantially different shapes and form, including different lengths, different geometries, etc.

Upon connection to the wireless communication unit, the antenna element or the antenna elements connected to the wireless communication unit may form a resonant antenna. In some embodiments the antenna elements forming the antenna of the hearing instrument may be a resonant antenna. In some embodiments the antenna elements forming the antenna of the hearing instrument may have one branch, the one branch may form a monopole antenna. In other embodiments, the antenna may have two branches extending from the wireless communication unit. The two branches may form a dipole antenna.

In some embodiments, the antenna element may have two branches connected to the wireless communication unit, both branches then being driven conductors. The branches may be similar or identical in form and shape, or the branches may be different in form and shape. In some embodiments, the two branches may form a dipole antenna. In some embodiments both branches of the antenna element, have a length to obtain a resonant antenna element for the electromagnetic radiation intended to be emitted from the hearing instrument. Typically, the length of the antenna elements are defined in relation to a wavelength A of the electromagnetic radiation to be emitted from the hearing instrument when it is positioned at its intended operational position at the ear of a user. It should be noted that in free air, for an antenna to be resonant, the length of the resonating element is selected to correspond to an odd multiple of a quarter-wavelength, $\lambda/4$, of a wavelength $\lambda$ of the electromagnetic radiation to be emitted from the hearing instrument.

The hearing instrument is typically configured to emit and receive electromagnetic radiation within a specific frequency range or band. In some embodiments, the frequency band is provided so as to include a resonance frequency for the antenna elements. Typically, the length of the antenna elements are optimized for use within such specific frequency bands, such as in a band about, or extending from, a peak resonant frequency.

Typically, the length of the antenna elements are selected to optimize the antenna for use at a specific frequency or within a specific frequency band, such as selected to provide an optimum resonance at a specific frequency, such as within a desired frequency band. Typically, the antenna is optimized for ISM bands, including cellular and WLAN bands, such as for GSM bands or WLAN bands.

The frequency band may be a frequency band comprising a frequency selected from the following frequencies, such as comprising 433 MHz, 800 MHz, 915 MHz, 1800 MHz, 2.4 GHz, 5.8 GHz, etc. Thus, the frequency band may be selected as an ISM band, such as a GSM band or a WLAN band comprising any one or more of these frequencies.

The hearing instruments as disclosed herein may be configured for operation in an ISM frequency band. Preferably, the antenna is configured for operation at a frequency of at least 400 MHz, such as of at least 800 MHz, such as of at least 1 GHz, such as at a frequency between 1.5 GHz and 6 GHz, such as at a frequency between 1.5 GHz and 3 GHz such as at a frequency of 2.4 GHz. The antenna may be optimized for operation at a frequency of between between 400 MHz and 6 GHz, such as between 400 MHz and 1 GHz, between 800 MHz and 1 GHz, between 800 MHz and 6 GHz, between 800 MHz and 3 GHz, etc.

However, it is envisaged that the hearing instrument as herein disclosed is not limited to operation in such a frequency band, and the hearing instrument may be configured for operation in any frequency band.

Thus, for a hearing instrument, such as a hearing instrument having a behind-the ear module, the first antenna element and the second antenna element are provided along opposite sides of the hearing instrument, such as along a first side away from the head of a user, such as a side pointing away from the head of the user, when the hearing instrument, such as for example a behind the ear module of a hearing instrument, is worn at its intended operational position at the ear of a user, and such as along a second side adjacent a user's head, such as a second side being closest to the head of a user, when the hearing instrument, such as for example a behind the ear module of a hearing instrument, is worn at its intended operational position at the ear of a user Typically, the hearing instruments are manufactured to fit both behind a right ear and behind a left ear of a user, for efficiency, both at the manufacturing side, and as the hearing instrument sales and fitting offices. During fitting of the hearing instrument to the intended user, the hearing instruments are configured and fitted to optimize the hearing loss compensation for the specific user, and the specific ear. During this fitting process, the hearing instrument is thus dedicated to the right ear or the left ear, respectively. In some embodiments, the switch control information may be generated at this stage.

The hearing instrument comprises a switching device, and the switching device is configured to connect a first antenna element of the plurality of antenna elements to the wireless communication unit, and at least a second antenna element of the plurality of antenna elements to a ground potential of the hearing instrument. The switching is performed in response to switch control information.

In some embodiments, the switching device is configured to, in response to first switch control information, connect a first antenna element of the plurality of antenna elements to the wireless communication unit, and at least a second antenna element of the plurality of antenna elements to a ground potential of the hearing instrument, and the switching device is configured to, in response to second switch control information, connect the second antenna element of the plurality of antenna elements to the wireless communication unit, and the first antenna element of the plurality of antenna elements to a ground potential of the hearing instrument.

The switching device may be any form of switching device capable of connecting an antenna element to either the wireless communication unit or to the ground potential for the hearing instrument, in dependence on switch control information.

In some embodiments, the switch control information is provided to the switching device during configuration of the hearing instrument, such as during initial configuration of the hearing instrument, such as during an audiologic fitting session, during a pre-fitting of the hearing instrument, etc.

As hearing instruments are complex devices with many features, and typically also many options selectable by the user, it may be advantageous that the switch control information is provided to the switching device during e.g. a fitting session.

The switch control information may for example be provided in response to a determination of the hearing instrument being configured to be worn at a right ear or a left ear of a user during use.

Thus, the switch control information may comprise information as to whether the hearing instrument is, or is being, configured to be worn at a right ear or a left ear of a user during use.

The switching device may be configured to select which antenna element of the plurality of antenna elements is the active antenna connected to the wireless communication unit, and which of the plurality of antenna elements is the passive antenna element connected to the ground potential.

By including a switching device, and thereby enable selection as to which of the plurality of antenna elements is being connected to the wireless communication unit, the electromagnetic radiation of the antenna system of the hearing instrument may be optimized according to any feature of the intended use of the hearing instrument or any feature of the intended user of the hearing instrument, for example the intended operational position of the hearing instrument during use, the intended use of helmets (e.g. for workers required to wear helmets, including firefighters, soldiers, building site workers, etc.), the form and shape of the ears of the intended user, the hair, the use of glasses, earhangers, piercings, etc.

In some embodiments, the switching device is configured to perform a limited number of switching operations, such as single switching operation. In some embodiments, the switching operation may only be performed while the hearing instrument is in communication with a hearing instrument fitting system, such as a hearing instrument fitting software.

In some embodiments the selection is a permanent selection. The connection of the first antenna element to the wireless communication unit may be a permanent connection. The connection of the second antenna element to the ground potential of the hearing instrument may likewise be a permanent connection. In some embodiments, the connection of the first antenna element to the wireless communication unit may be a permanent connection, while the connection of the second antenna element to the ground potential of the hearing instrument may be reversible or changeable, and vice versa.

In some embodiments, the connection of the first antenna element to the wireless communication unit may be a permanent connection, such as a semi-permanent connection, upon switching, while the connection of the at least second antenna element to the ground potential may be reversible, and/or changeable.

The hearing instrument may comprise at least a third antenna element, the third antenna element being connected to the ground potential of the hearing instrument. The switching device may be configured to connect the third antenna element to the ground potential in response to switch control information. The hearing instrument may have one or more antenna elements connected to the ground potential of the hearing instrument, and thus configured to function as passive antenna elements. The switching device may be configured to connect the one or more antenna elements to the ground potential in response to switch control information.

The antenna system may comprise a plurality of antenna elements, and in some embodiments, one of the plurality of antenna elements, such as a single one of the plurality of antenna elements, is connected to the wireless communication unit upon configuration. Other of the plurality of antenna elements, such as one antenna element, two antenna elements, such as a second and third antenna element, two or more antenna elements, may be configured to be connected to a ground potential and contribute to the generation of the desired electromagnetic field to be generated by the antenna system as passive antenna elements. For example a third antenna element may be positioned along another side of the hearing instrument, such as along another side of a behind-the-ear module, such as on a top side of a behind-the-ear module. The third antenna element may during configuration of the hearing instrument, be connected to the ground potential.

In some embodiments, the switch control information comprises an electrical part. In some embodiments the switch control information comprises a mechanical part. In some embodiments, the switch control information comprises a mechanical part and an electrical part. In some embodiments, the connection performed in response to the mechanical part of the switch control information may be permanent or semi-permanent, while the connection performed in response to the electrical part of the switch control information may be changeable.

In some embodiments, switch control information is received from a fitting system. Such switch control information is typically electrical. In some embodiments, switch control information is obtained via the signal processor of the hearing instrument.

In some embodiments, the hearing instrument comprises a connector receptacle and a connector element, the connector element being configured to engage with the switching device via the connector receptacle to provide mechanical switch control information.

The connector element may be a receiver-in-the-ear connector element, an ear hook connector, a tube connector, etc.

The connector element may be configured to be assembled with e.g. a behind-the-ear module, or an in-the-ear module, during fitting of the hearing instrument. The connector element may form part of a tube module to be assembled with the behind-the-ear module, or an in-the-ear module A hearing instrument comprising: a microphone for reception of sound and conversion of the received sound into a corresponding first audio signal; a signal processor for providing a second audio signal based on the first audio signal, the second audio signal compensating a hearing loss of a user of the hearing instrument; a speaker coupled to an output of the signal processor for providing an output sound signal based on the second audio signal; a wireless communication unit coupled to the signal processor for wireless communication; and an antenna system coupled to the wireless communication unit, the antenna system configured for electromagnetic field emission and electromagnetic field reception, the antenna system comprising a plurality of antenna elements and a switching device; wherein the switching device is configured to connect a first antenna element of the plurality of antenna elements to the wireless communication unit, and at least a second antenna element of the plurality of antenna elements to a ground potential of the hearing instrument in response to switch control information.

Optionally, the first antenna element is on a first side of the hearing instrument, and the second antenna element is on a second side of the hearing instrument.

Optionally, the first side of the hearing instrument is adjacent a head of the user when the hearing instrument is worn in an operational position at an ear of the user.

Optionally, the switching device is configured to receive the switch control information during configuration of the hearing instrument.

Optionally, the switch control information is based on an intended operational position of the hearing instrument, the intended operational position being a right ear or a left ear of the user.

Optionally, the switching device is configured to perform a single, or a limited number of, switching operation(s).

Optionally, the hearing instrument further includes a third antenna element, the third antenna element being connected to the ground potential of the hearing instrument.

Optionally, the switch control information comprises an electrical switch control information.

Optionally, the switch control information comprises a mechanical switch control information.

Optionally, the hearing instrument comprises a connector receptacle and a connector element, the connector element being configured to engage with the switching device via the connector receptacle to provide the mechanical switch control information.

Optionally, the connector element is a receiver-in-the-ear connector element, an ear hook connector, or a tube connector.

Optionally, the hearing instrument comprises at least one behind-the-ear module configured to be positioned behind an ear of the user, the behind-the-ear module comprising at least the signal processor and at least one of the antenna elements.

A method of configuring a hearing instrument, the hearing instrument comprising a microphone for reception of sound and conversion of the received sound into a corresponding first audio signal, a signal processor for providing a second audio signal based on the first audio signal, the second audio signal compensating a hearing loss of a user of the hearing instrument, a speaker coupled to an output of the signal processor for providing an output sound signal based on the second audio signal, a wireless communication unit coupled to the signal processor for wireless data communication, and an antenna system for electromagnetic field emission and electromagnetic field reception, the antenna system comprising a plurality of antenna elements and a switching device, the method includes: determining an intended operational position of the hearing instrument; providing switch control information to the switching device based on the determined intended operational position of the hearing instrument; and switching the switching device so that a first antenna element of the plurality of antenna elements is connected to the wireless communication unit, and a second antenna element of the plurality of antenna elements is connected to a ground potential of the hearing instrument in response to the switch control information.

Optionally, the switching device is configured to perform a single, or a limited number of, switching operation(s).

It is envisaged that any of the features described herein may be used in combination, or may be combined, with other feature(s) described herein. The above and other features and advantages will become more apparent to those of ordinary skill in the art by describing in detail exemplary embodiments thereof with reference to the attached drawings.

BRIEF DESCRIPTION OF THE DRAWING

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The embodiments will now be described more fully hereinafter with reference to the accompanying drawings, in which exemplary embodiments are shown. The claimed invention may, however, be embodied in different forms and should not be construed as limited to the embodiments set forth herein.

Figure 1:
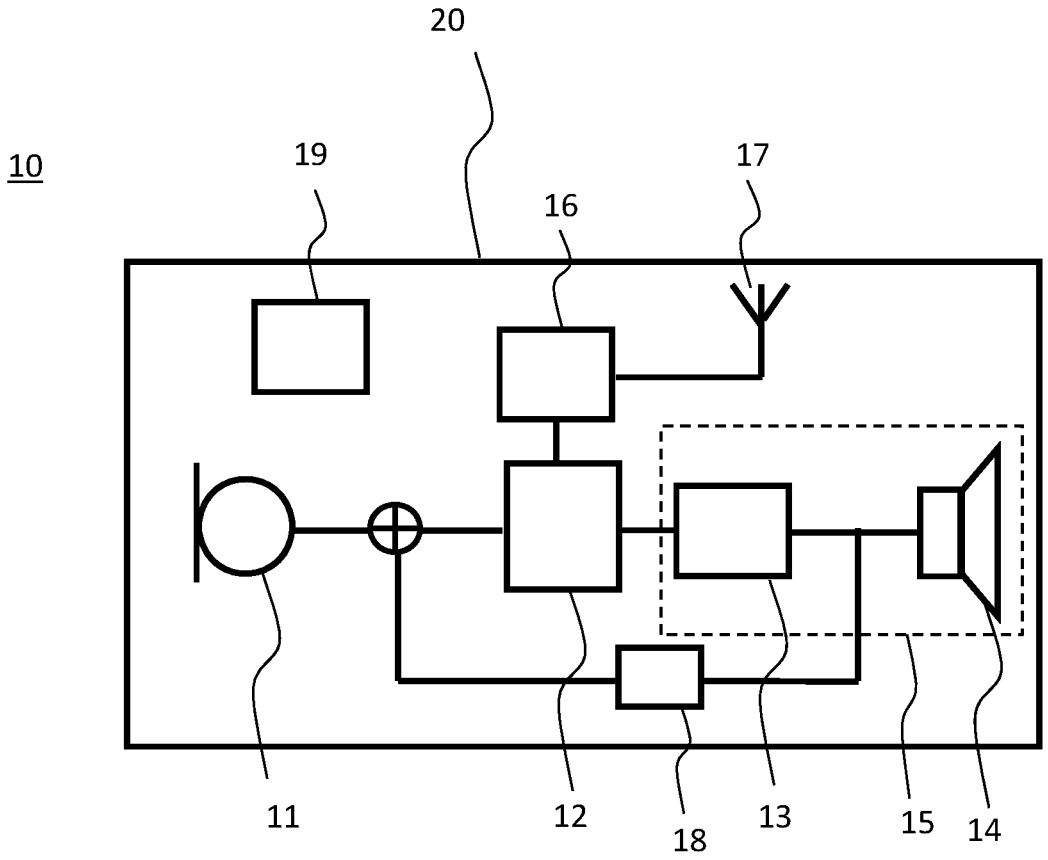
FIG. 1 shows a block-diagram of a typical hearing instrument.

A block-diagram of a typical (prior-art) hearing instrument 10 is shown in FIG. 1. The hearing instrument 10 comprises a first transducer, i.e. microphone 11, for receiving incoming sound and converting it into an audio signal, i.e. a first audio signal. The first audio signal is provided to a signal processor 12 for processing the first audio signal into a second audio signal compensating a hearing loss of a user of the hearing aid. A receiver 13 is connected to an output of the signal processor 12 for converting the second audio signal into an output sound signal, e.g. a signal modified to compensate for a user's hearing impairment, and provides the output sound to a transducer 14. Typically, the receiver 13 and transducer 14 are combined and referred to as speaker 15, implicitly including receiver 13 and transducer 14.

Thus, the hearing instrument signal processor 12 comprises elements such as amplifiers, compressors and noise reduction systems etc. The hearing instrument or hearing aid may further have a filter function, such as compensation filter 18 for optimizing the output signal. The hearing aid may furthermore have a wireless communication unit 16 for wireless data communication interconnected with an antenna system 17 for emission and reception of an electromagnetic field. The wireless communication unit 16, such a radio or a transceiver, connect to the hearing instrument signal processor 12 and the antenna system 17, for communicating with external devices, or with another hearing instrument, such as another hearing instrument, located at another ear, typically in a binaural hearing instrument system. The hearing instrument 10 further comprises a power source 19, such as a battery.

The hearing instrument may be a behind-the ear hearing instrument, and may be provided as a behind-the-ear module 20.

Figure 2:
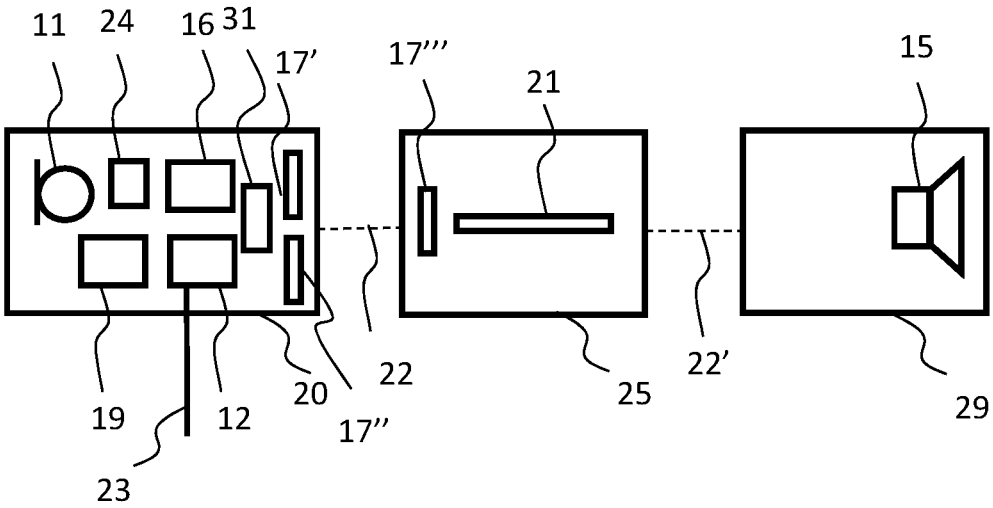
FIG. 2 shows a hearing instrument having a behind-the-ear module and an in-the-ear module.

In FIG. 2 a schematic illustration of hearing instrument modules is provided. Behind-the-ear module 20 comprises the microphone 11, the processor 12, the radio (i.e. wireless communication unit) 16, a power source 19, as well as a part 17', 17" of the antenna system 17. Tube module 25 comprises another part 17'" of the antenna system 17 and a tube element 21. The tube element may provide sound as an acoustic signal or as an electrical signal to the ear of a user. In-the-ear module 29 comprises speaker 15.

The configuration as shown in FIG. 2 is an exemplary configuration only. Some types of behind-the-ear hearing aid comprise only the behind-the-ear module 20 and the tube module 25. Some type of in-the-ear hearing aids or completely-in-the-canal hearing aids, comprises only the in-the-ear module 29, the in-the-ear module 29 then comprising the hearing instrument components, including microphone 11, signal processor 12, radio 16, power source 18, as well as antenna system 17. The modules may be interconnected in any way, mechanically and/or electrically, as indicated by dashed lines 22, 22'. Typically, connectors are mounted at the tube, such as at first and second ends of the tube.

As illustrated in FIG. 2, the behind-the-ear module comprises a first antenna element 17' and a second antenna element 17" and the switching device 31 may be configured to switch the connection to the wireless communication unit or radio 16 between the first antenna element 17' and the second antenna element 17" in response to switch control information 23 received by the signal processor 12. The other of the first and second antenna element 17" may be connected to a ground potential. The antenna element 17'" may be a third antenna element, and the switching device may in some embodiments be configured to switch the third antenna element to the ground potential in addition to one of the first or second antenna elements, or alternatively to the first or second antenna elements. It is envisaged that the third antenna element may be positioned anywhere, and thus both in the tube module, in the behind-the-ear module, in an in-the-ear module, etc.

It should be envisaged that modern types of hearing instruments provide for any number of options and possibilities when it comes to the combination of modules, and the content of the modules. For example, some types of in-the-ear hearing instruments comprise all hearing instrument components, apart from the power source, which is positioned in a behind-the-ear module. Numerous other options may also be offered.

Each module may be provided in a housing, the components of the behind-the-ear module 20 may be provided in a behind-the-ear housing, the components of an in-the-ear module may be provided in an in-the-ear housing, etc.

In some embodiments, the antenna system 17 is confined within the behind-the-ear housing or the antenna system 17 is confined within the in-the-ear housing. That is, the antenna system is confined within the respective housing so that no part of the antenna is protruding of the housing, or so that the housing does not have special protrusions accommodating any special parts of the antenna elements. Likewise, the antenna system may be confined within a number of the respective housing, e.g. within the behind-the-ear housing and within the interconnected tube or tube module housing.

However, also other embodiments of the antenna system and other antenna system configurations may be contemplated. For example, one part of the antenna system may be provided in one module, and other parts of the antenna system may be provided one or more other modules.

Figure 3:
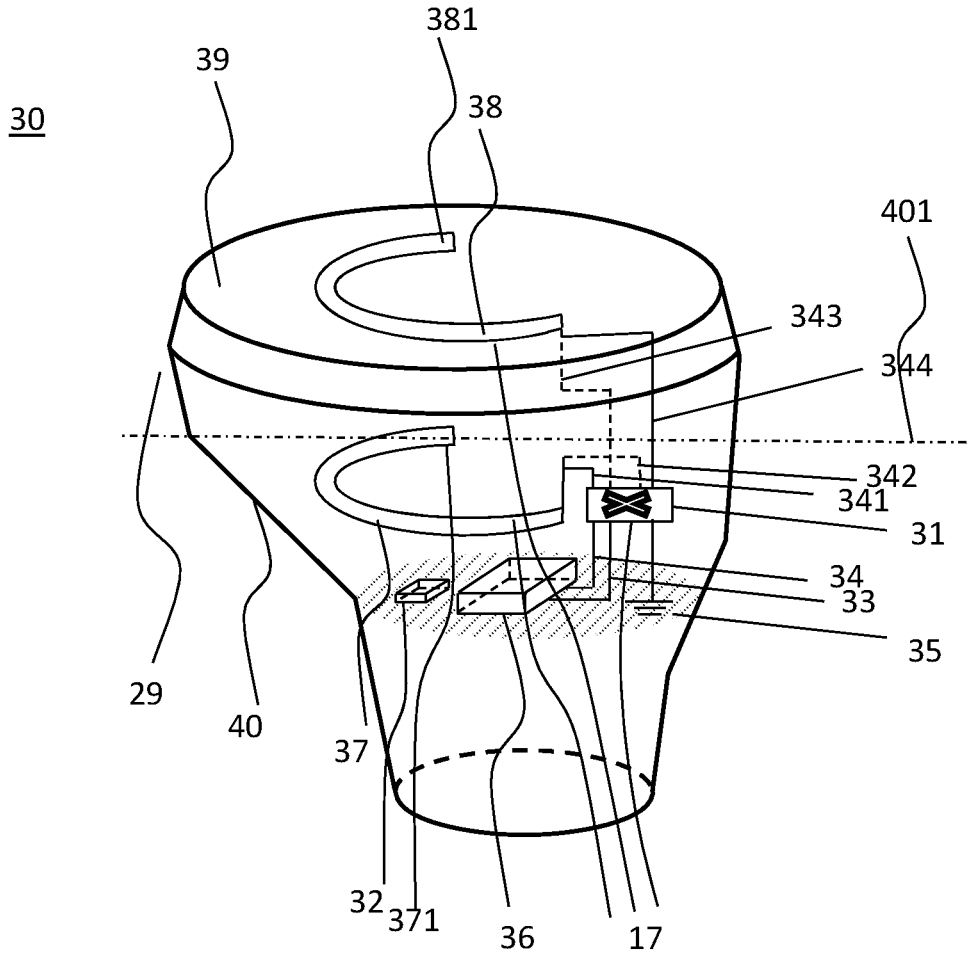
FIG. 3 shows a hearing instrument of the in-the-ear type having an antenna and wireless communication unit.

FIG. 3 shows an exemplary in-the-ear hearing instrument 30 having an antenna system 17 according to one embodiment of the present disclosure. The in-the ear hearing instrument has a face plate 39 and a housing or shell 40, The hearing instrument 30 has an in-the-ear module 29 comprising the hearing instrument components, including a wireless communication unit 36 for wireless communication interconnected with antenna system 17 for emission and/or reception of an electromagnetic field. The wireless communication unit 36 is connected to hearing instrument signal processor 32. The wireless communication unit 36 is connected to the antenna system 17, for communicating with e.g. external devices, or with another hearing instrument, such as another hearing instrument located at another ear, in a binaural hearing aid system. A ground potential for the hearing instrument is provided as ground 35.

The antenna system 17 comprises a switching device 31, the switching device 31 being, at the input side, connected to the wireless communication unit 36 a first transmission line 33 and second transmission line 34. The switching device 31 is furthermore connected to the ground 35, at the input side.

The switching device 31 connects at the output to first antenna element 37 and to second antenna element 38. The switching device 31 comprises a two-way switch, and switches the first antenna element 37 to the wireless transmission unit 36 or to the ground potential 35. Likewise, the switching device 31 switches the second antenna element 38 to the ground potential 35 or to the wireless transmission unit 36. As illustrated in FIG. 3, in the state of the switch configures the first antenna element 37 to be connected to the wireless communication unit 36 via line 341, while having the potential to be connected to the ground 35 as illustrated by dashed line 342, and configures the second antenna element 38 to be connected to the ground potential 35, via line 344, while having the potential to be connected to the wireless communication unit 36 as illustrated by dashed line 343.

The first antenna element 37 and the second antenna element 38 may be symmetrically arranged around a symmetry plane 401, and as illustrated first antenna element 37 has a first free end 371, and antenna element 38 has a second free end 381. Thus, the first antenna element when connected to the wireless communication unit 36 may be a monopole antenna, and likewise, the second antenna element when connected to the wireless communication unit 36 may be a monopole antenna.

Figure 4:
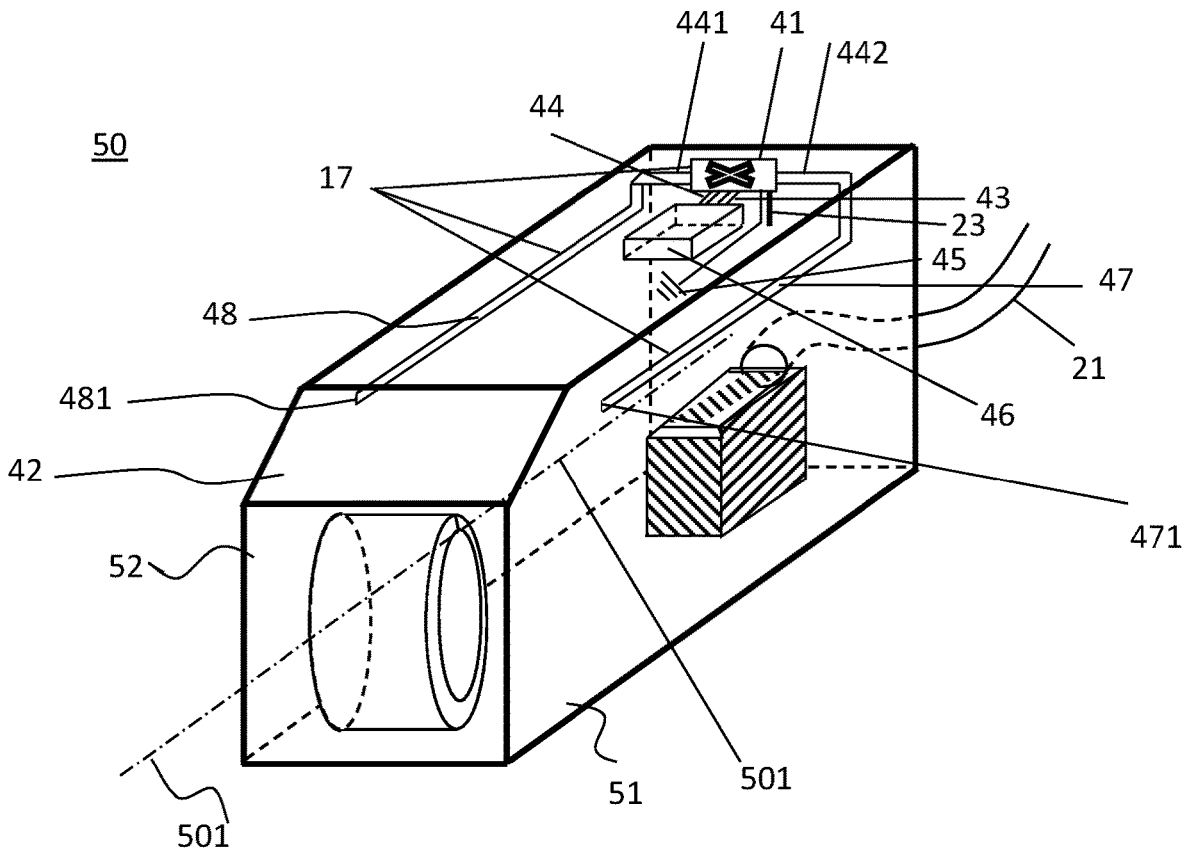
FIG. 4 shows a behind the ear hearing instrument an antenna and wireless communication unit.

FIG. 4 shows an exemplary behind-the-ear hearing instrument 50 having an antenna system 17 according to one embodiment of the present disclosure. The behind-the ear hearing instrument has a housing or shell 42 and is interconnected with tube element 21. The hearing instrument 50 has a behind-the-ear module comprising the hearing instrument components, including a wireless communication unit 46 for wireless communication interconnected with antenna system 17 for emission and/or reception of an electromagnetic field. The wireless communication unit 46 is connected to hearing instrument signal processor (not shown). The wireless communication unit 46 is connected to the antenna system 17, for communicating with e.g. external devices, or with another hearing instrument, such as another hearing instrument located at another ear, in a binaural hearing aid system. A ground potential for the hearing instrument is provided as ground 45.

The antenna system 17 comprises a switching device 41, the switching device 41 being, at the input side, connected to the wireless communication unit 46, a first transmission line 43 and second transmission line 44. The switching device 41 is furthermore connected to the ground 45, at the input side.

The switching device 41 connects at the output to first antenna element 47 and to second antenna element 48. The switching device 41 comprises a two-way switch, and switches the first antenna element 47 to the wireless communication unit 46 or to the ground potential 45. Likewise, the switching device 41 switches the second antenna element 48 to the ground potential 45 or to the wireless transmission unit 46. In FIG. 4, the state of the switch configures the first antenna element 47 to be connected to the wireless communication unit 46 output 441, while having the potential to be connected to the ground 45, and configures the second antenna element 48 to be connected to the ground potential 45, via line 442, while having the potential to be connected to the wireless communication unit 46.

The first antenna element 47 and the second antenna element 48 may be symmetrically arranged around a symmetry plane 501, and as illustrated first antenna element 47 has a first free end 471, and antenna element 48 has a second free end 481. Thus, the first antenna element when connected to the wireless communication unit 46 may be a monopole antenna, and likewise, the second antenna element when connected to the wireless communication unit 46 may be a monopole antenna.

The hearing instrument 50 has a first side 51 and a second side 52, and the first antenna element extends along the first side, while the second antenna element extends along a second side. For a hearing instrument configured to be worn at a right ear of a user, the second side 52 of the hearing instrument 50 will be adjacent a user's head.

For a hearing instrument configured to be worn at a left ear of a user, the first side 51 of the hearing instrument 50 will be adjacent a user's head.

It is thus foreseen that for a hearing instrument configured to be worn at a right ear of a user, the switching device will connect the first antenna element to the wireless communication unit 46, to obtain an active antenna element at the first side of the hearing instrument, and a passive antenna element at the second side 52 of the hearing instrument adjacent a user's head.

Likewise, for a hearing instrument configured to be worn at a left ear of a user's head, the switching device will connect the second antenna element 48 to the wireless communication unit 46, to obtain an active antenna element at the second side 52 of the hearing instrument, and a passive antenna element at the first side 51 of the hearing instrument adjacent a user's head.

The switch control information 23 is communicated to the switching device 41 via the signal processor, and sent from the signal processor to the switching device as a control input. The switch control information 23 may for example be sent to the hearing instrument processor from an external device, such a fitting system, such as a system having software for fitting of a hearing instrument to a user, via the wireless communication unit.

Figure 5:
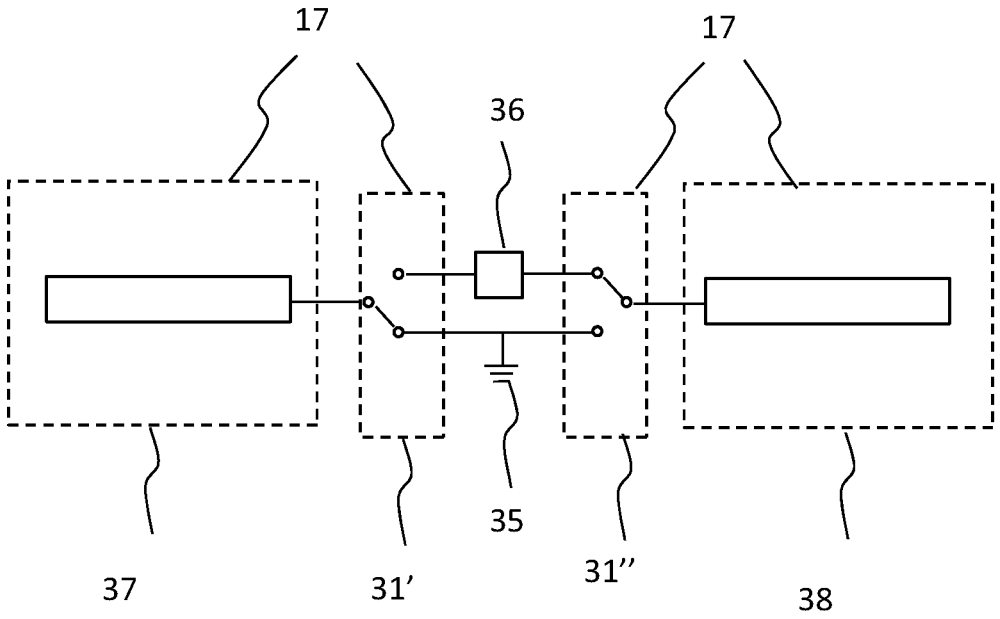
FIG. 5 shows a schematic illustration of a switching device.

FIG. 5 shows a schematic illustration of a two-way switching device. For simplicity only a two-way switching is shown, but also more antenna elements may be switched by the switching device, for example to connect more specific antenna elements to the ground potential, to e.g. tailor the electromagnetic radiation even more specifically to the head of the user, or the intended user of the hearing instrument.

The first antenna element 37 is connected to a first part 31' of the switching device, connected the first antenna element to the wireless communication device 36. The second antenna element 38 is connected to a second part 31" of the switching device, connecting the second antenna element to the ground potential 35. In FIG. 5, the antenna system 17 is illustrated comprising the first antenna element 37, the second antenna element 38 and the switching device 31', 31"

FIG. 6 shows a plug for providing mechanical switching control information.

The hearing instrument, in the present drawing illustrated by behind-the-ear module 20, connector 53 and tube 21, comprises a connector receptacle 55 and a connector element 53, the connector element being configured to engage with the switching device 31 via the connector receptacle 55 and connector switching part 54 to provide mechanical switch control information.

Figure 6A:
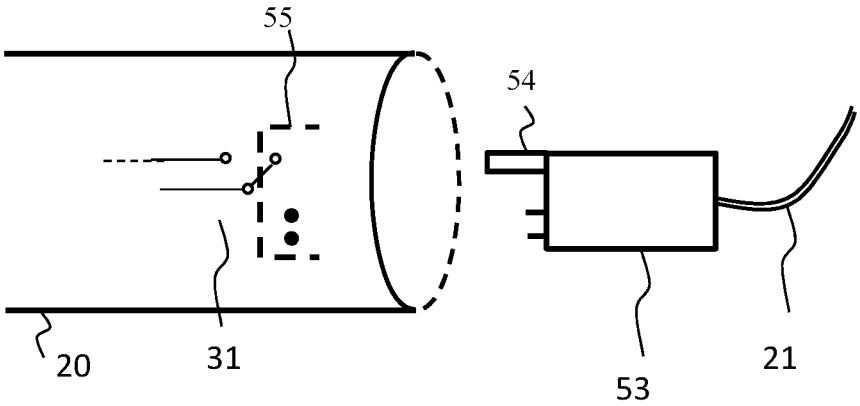
FIG. 6A shows a connector and a behind-the-ear module.
Figure 6B:
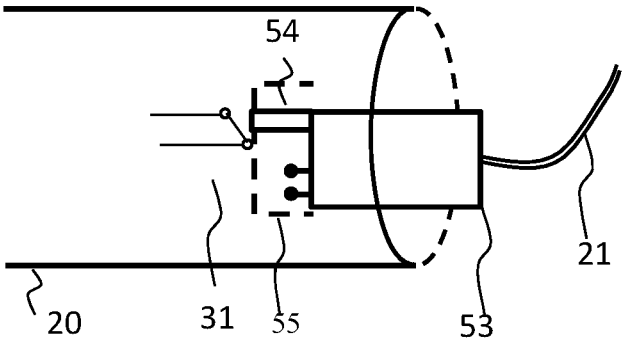
FIG. 6B shows the connector of FIG. 6A coupled to the behind-the-ear module.
Figure 6C:
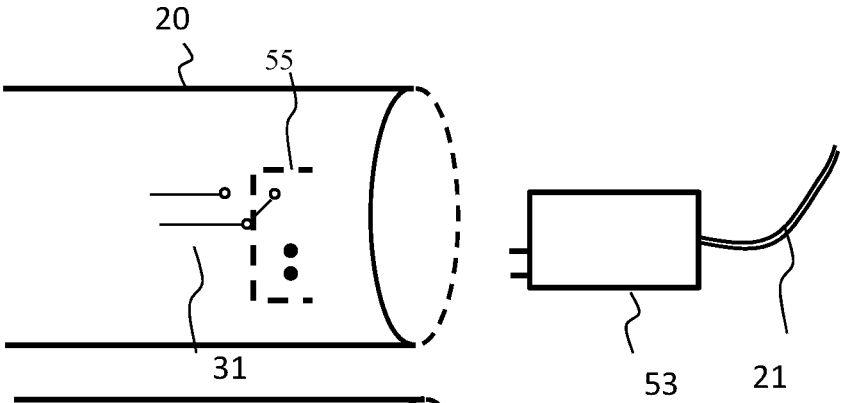
FIG. 6C shows another connector and a behind-the-ear module.
Figure 6D:
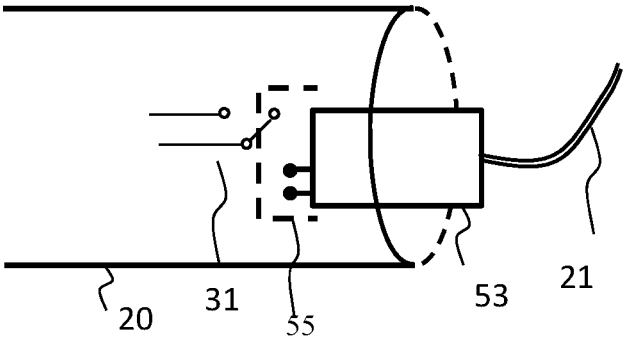
FIG. 6D shows the connector of FIG. 6C coupled to the behind-the-ear module.

The connector element 53 may in a simple form be provided with a switching part 54 when configured to switch the switching device, as illustrated in FIGS. 6*a*) and 6*b*). In FIG. 6*b*), the connector element is shown engaged with the receptacle 55 and it is seen that the switching part 54 switches the switch 31 from a first position as shown in FIG. 6*a*) to a second position. The connector element 53 may in a simple form be provided without a switching part 54 when configured not to switch the switching device, as illustrated in FIGS. 6*c*) and 6*d*). In FIG. 6*d*), the connector element is shown engaged with the receptacle 55 and it is seen that as no switching part 54 is provided, the switching device 31 is maintained in the first position as shown in FIG. 6*c*).

In some embodiments the tube and the connector element are configured for a right ear and a left ear, respectively. Thus, the connector element may be provided with a switching part 54 if configured for a right ear, and without a switching part 54 if configured for a left ear, or vice versa.

It is envisaged that a skilled person will understand that there are numerous ways to provide switch control information by mechanical means, and the skilled person will understand that mechanical switch control information may be conferred in numerous ways.

LIST OF REFERENCES

10, 30, 50 hearing instrument
11 first transducer microphone
12 signal processor
13 receiver
14 transducer
15 speaker
16 wireless communication unit
17 antenna system,
17' first antenna element
17" second antenna element
17'" third antenna element
18 compensation filter
19 power source
20 behind-the-ear module
21 tube element
22, 22' interconnections

23 switch control information
24 switching device
25 tube module
29 in-the-ear module
31, 31', 31", 41 switching device
32 signal processor
33, 34, 43, 44 transmission line
35, 45 ground
36, 46 wireless communication unit
37, 47 first antenna element
38, 48 second antenna element
371, 471 free end of first antenna element
381, 481 free end of second antenna element
39 face plate
40, 42 housing, shell
401, 501 symmetry plane
43, 44 transmission line
51 first side
52 second side
53 connector
54 connector switching part
55 connector receptacle
441 output
442 line Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument comprising:

a microphone for reception of sound and conversion of the received sound into a corresponding first audio signal;

a signal processor for providing a second audio signal based on the first audio signal, the second audio signal compensating a hearing loss of a user of the hearing instrument;

a speaker coupled to an output of the signal processor for providing an output sound signal based on the second audio signal;

a wireless communication unit coupled to the signal processor for wireless communication; and an antenna system coupled to the wireless communication unit, the antenna system configured for electromagnetic field emission and electromagnetic field reception, the antenna system comprising a plurality of antenna elements and a switching device;

wherein the switching device is configured to actively feed a first antenna element of the plurality of antenna elements, and passively feed at least a second antenna element of the plurality of antenna elements, in response to switch control information.

2. The hearing instrument according to claim 1, wherein the first antenna element is on a first side of the hearing instrument, and the second antenna element is on a second side of the hearing instrument.

3. The hearing instrument according to claim 2, wherein the first side of the hearing instrument is adjacent a head of the user when the hearing instrument is worn in an operational position at an ear of the user.

4. The hearing instrument according to claim 1, wherein the switching device is configured to receive the switch control information during configuration of the hearing instrument.

5. The hearing instrument according to claim 1, wherein the switch control information is based on an intended operational position of the hearing instrument, the intended operational position being a right ear or a left ear of the user.

6. The hearing instrument according to claim 1, wherein the switching device is configured to perform a single, or a limited number of, switching operation(s).

7. The hearing instrument according to claim 1, further comprising a third antenna element, the third antenna element being connected to a ground potential of the hearing instrument.

8. The hearing instrument according to claim 1, wherein the switch control information comprises an electrical switch control information.

9. The hearing instrument according to claim 1, wherein the switch control information comprises a mechanical switch control information.

10. The hearing instrument according to claim 9, wherein the hearing instrument comprises a connector receptacle and a connector element, the connector element being configured to engage with the switching device via the connector receptacle to provide the mechanical switch control information.

11. The hearing instrument according to claim 10, wherein the connector element is a receiver-in-the-ear connector element, an ear hook connector, or a tube connector.

12. The hearing instrument according to claim 1, wherein the hearing instrument comprises at least one behind-the-ear module configured to be positioned behind an ear of the user, the behind-the-ear module comprising at least the signal processor and at least one of the antenna elements.

13. A method of configuring a hearing instrument, the hearing instrument comprising a microphone for reception of sound and conversion of the received sound into a corresponding first audio signal, a signal processor for providing a second audio signal based on the first audio signal, the second audio signal compensating a hearing loss of a user of the hearing instrument, a speaker coupled to an output of the signal processor for providing an output sound signal based on the second audio signal, a wireless communication unit coupled to the signal processor for wireless data communication, and an antenna system for electromagnetic field emission and electromagnetic field reception, the antenna system comprising a plurality of antenna elements and a switching device, the method comprising:

determining an intended operational position of the hearing instrument;

providing switch control information to the switching device based on the determined intended operational position of the hearing instrument; and switching the switching device so that a first antenna element of the plurality of antenna elements is actively fed, and a second antenna element of the plurality of antenna elements is passively fed, in response to the switch control information.

14. The method according to claim 13, wherein the switching device is configured to perform a single, or a limited number of, switching operation(s).

* * * * *